US006017232A

United States Patent [19]

Tondreault et al.

[11] Patent Number: 6,017,232

[45] Date of Patent: Jan. 25, 2000

[54] ELECTRICAL INTERCONNECT DEVICE WITH MODULE EJECTION MEANS

[75] Inventors: Robert J. Tondreault, Louisville, Ky.; Robert W. Rollings, Georgetown; James F. DePriest, New Albany, both of Ind.

[73] Assignee: Robinson Nugent, Inc., New Albany, Ind.

[21] Appl. No.: 07/919,829

[22] Filed: Jul. 27, 1992

Related U.S. Application Data

[63] Continuation of application No. 07/725,581, Jul. 3, 1991, Pat. No. 5,147,211.

[51] Int. Cl.[7] ..... H01R 13/62

[52] U.S. Cl. ..... 439/160; 439/152

[58] Field of Search ..... 439/152–160, 439/372; 361/413, 414, 415

[56] References Cited

U.S. PATENT DOCUMENTS

| | | | |
|---|---|---|---|
| 2,817,825 | 12/1957 | Zettle et al. . | |
| 2,987,693 | 6/1961 | Wamsley . | |
| 3,150,906 | 9/1964 | Chambon et al. . | |
| 3,271,626 | 9/1966 | Howrilka | 439/152 |
| 3,360,689 | 12/1967 | Haury | 439/152 |
| 3,853,379 | 12/1974 | Goodman et al. . | |
| 4,057,879 | 11/1977 | Eigenbrode . | |
| 4,070,081 | 1/1978 | Takahashi . | |
| 4,075,444 | 2/1978 | Hollingsead et al. . | |
| 4,582,378 | 4/1986 | Fruchard . | |
| 4,698,024 | 10/1987 | Maxwell . | |
| 4,836,790 | 6/1989 | Narita . | |
| 4,898,540 | 2/1990 | Saito . | |
| 4,973,255 | 11/1990 | Rudoy . | |
| 4,990,097 | 2/1991 | Billman et al. . | |
| 5,013,264 | 5/1991 | Tondreault . | |
| 5,057,029 | 10/1991 | Noorily . | |
| 5,106,315 | 4/1992 | Billman et al. . | |

*Primary Examiner*—Paula Bradley
*Assistant Examiner*—Tho D. Ta
*Attorney, Agent, or Firm*—Barnes & Thornburg

[57] ABSTRACT

An electrical interconnect device includes an elongated socket for releasably holding a module in an engaged position therein and an ejector for ejecting at least a portion of the module from the socket. The device also includes a lever arm for rotating the module ejector means about an axis of rotation extending in the direction of elongation of the socket to move the module ejector against a module held in the socket. This action causes at least a portion of the module to be disengaged from the socket means to enable a user to extract the module from the socket means. The rotatably actuated module ejector is mounted on the device to lie between two modules that are held in side-by-side relation in the socket. The lever arm is pivotable about an axis of rotation either in a clockwise or counterclockwise direction to permit a technician to remove more than one module from the socket.

23 Claims, 2 Drawing Sheets

ELECTRICAL INTERCONNECT DEVICE WITH MODULE EJECTION MEANS

This is a continuation of application Ser. No. 07/725,581 filed Jul. 3, 1991, now U.S. Pat. No. 5,147,211.

BACKGROUND AND SUMMARY OF THE INVENTION

This invention relates to electrical interconnect devices, and particularly to electrical connectors including module extraction apparatus. More particularly, the invention relates to an electrical connector including means for ejecting one or more modules attached to the electrical connector.

An electrical interconnect device is a useful tool for connecting electrical components to one another. Typically, an electrical interconnect device will include a socket for holding and retaining one or more modules therein so that the modules are coupled electrically, for instance, to a printed circuit board. A module is typically any electrical component, package, or edge card having contacts that can be inserted into the socket provided by the electrical interconnect device. An edge card is a variety of printed circuit board that can be mounted in a socket. The socket mechanically holds a module in place in an interconnect device and provides an electrically conductive path so that the module can be connected electrically to a printed circuit board.

One problem with conventional electrical connectors is that it is often difficult to extract a module that is held in the socket formed in the electrical connector. It will be understood that modules are often socketed close to one another on an electrical connector in tight quarters, making it hard for a technician to pry a selected module out of the connector socket manually by hand or using a tool. A delicate module can be damaged easily during extraction by rough handling if means is not available to permit a user to remove the module consistently with minimum effort.

Another problem is that it is often difficult to remove a module which has many contacts engaging a connector socket and spreading out over a large area. These large modules must be replaced from time to time and an apparatus configured to help a technician extract such large modules from a connector socket without damaging either the module itself or neighboring modules would be useful.

It is known to provide an electrical connector with module extraction apparatus. See, for example, U.S. Pat. No. 4,990,097 to Billman et al wherein a handle on the connector can be lifted to permit a circuit panel member to be withdrawn from a socket and U.S. Pat. No. 4,070,081 to Takahashi wherein swinging lifting levers are provided for prying a module upwardly out of a socket. See also U.S. Pat. No. 2,987,693 to Wamsley.

It has been observed that technicians often find it a difficult task to grip a handle of the type disclosed in the Billman et al '097 patent using their fingers to actuate the extraction device. This is especially true if the socket is nestled in close proximity to other components or devices. It will be understood that, in many cases, a great deal of lifting force must be applied by a technician to a socketed module to extract it from a socket and that the fingers of a technician could be hurt during manual module extraction activities. Of course, such a lifting force problem is made worse if the module to be extracted has many socket-engaging contacts spreading out over a large area of the socket. The Takahashi '081 levers provide more mechanical advantage, but take up space which is not always available in a high-density system. The Wamsley '693 lever assembly is not a part of the socket itself and is mounted on a plate separate from the socket.

According to the present invention, an electrical interconnect device includes an elongated socket including means for releasably holding a module in an engaged position therein and means for ejecting at least a portion of the module from the holding means. The device also includes means for rotating the ejecting means about an axis of rotation extending in the direction of elongation of the socket to move the ejecting means against a module held in the socket means. This action causes at least a portion of the module to be disengaged from the socket means to enable a user to extract the module from the socket means.

In preferred embodiments, the ejecting means is a half-moon-shaped cam member and the rotating means includes a lever arm having a hand grip at one end and a pivot post coupled to the other end. The pivot post extends through a channel formed in the socket to connect to the cam member. The pivot post is rotatable in the channel about the central axis of the pivot post.

In use, the lever arm is pivoted by a technician to rotate about the axis of rotation of the pivot post to cause a module to be extracted from the socket. The lever arm is used to rotate the pivot post in the channel formed in the socket to cause the cam member to rotate and urge a module held in the holding means out of engagement with the holding means to enable a user to extract the module from the socket.

One feature of the improved electrical interconnect device is that it is provided with a compact rotatably actuated module ejection assembly. The cam member and the lever arm rotate about the axis of rotation established by the pivot post. To assist in extracting a socketed module, a great deal of leverage is generated by use of a lever arm that is pivotable to rotate a cam member to a position disengaging a module from a socketed position in a connector socket. This provides a very simple and natural motion to a technician assigned to manually remove either large or small modules from a connector socket. Due to the lever arm advantage, the force required to eject a module from the connector socket is relatively low. This is true even if the module to be extracted has many socket-engaging contacts spreading out over a large area on the socket. One advantage of this feature is that resultant forces during actuation act to keep the interconnect device securely coupled to the underlying printed circuit board instead of tending to pull the device away from the printed circuit board. In addition, the lever arm is coupled to the socket to pivot about an axis that extends in the direction of elongation of the socket to provide a compact module ejector assembly on the socket.

Another feature of the present invention is that the rotatably actuated module ejection assembly is mounted on an electrical connector to lie between two modules that are arranged in side-by-side relation and socketed to the connector. The ejection assembly includes a lever arm mounted to an electrical connector and coupled to a cam member as described above. The lever arm is pivotable about an axis of rotation either in a clockwise direction to move the cam member in one direction to eject the first modules from engagement with its connector socket or in a counterclockwise direction to move the cam member in another direction to eject the second module from engagement with its connector socket. Advantageously, a single pivotable lever arm and cam assembly is operable to permit a technician to remove more than one socketed module from an electrical connector.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
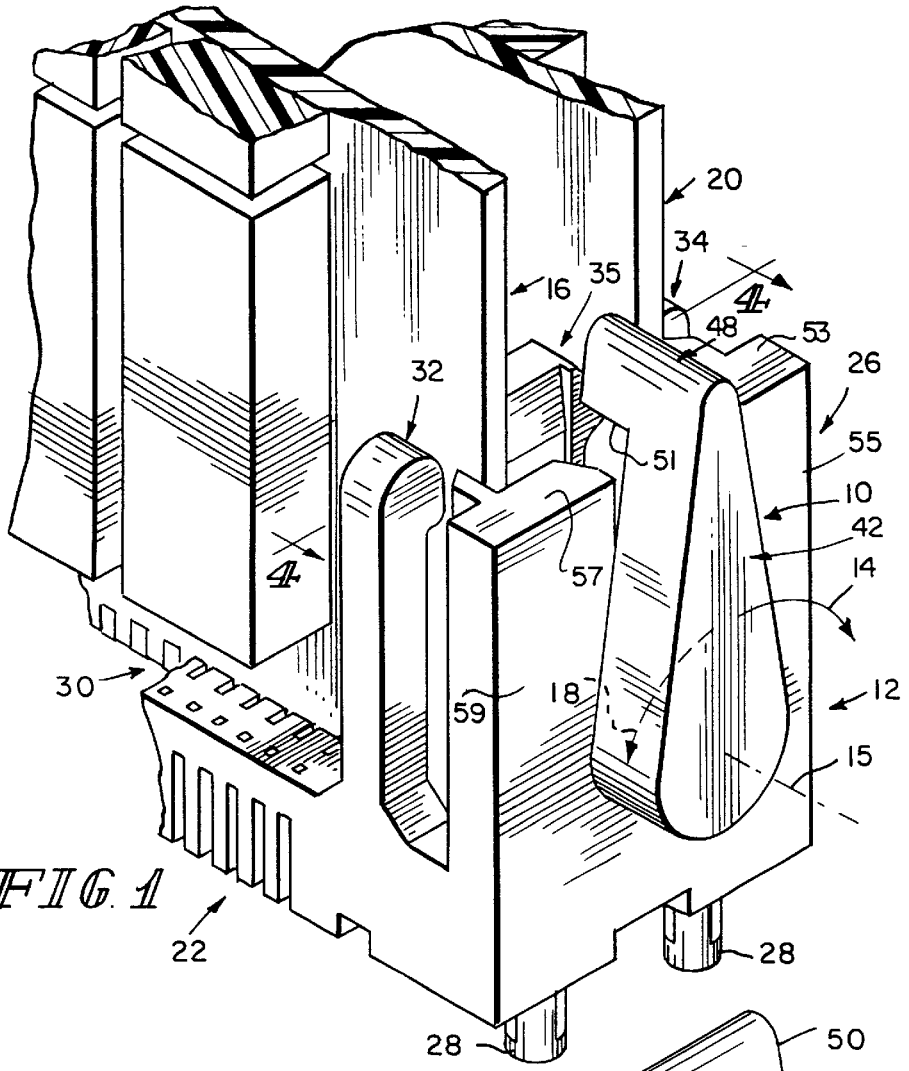
FIG. 1 is a perspective view showing two modules socketed in the base of an electrical connector and arranged to lie in side-by-side relation and a rotatably actuated module ejector assembly mounted for rotation to an end piece of the electrical connector.

Referring to FIG. 1, a module ejector assembly 10 is mounted to an electrical connector 12 and operable to rotate in a first direction 14 about axis of rotation 15 to eject a first module 16 from a socketed position in electrical connector 12. The module ejector assembly 10 is alternately rotatable about axis of rotation 15 in an opposite direction 18 to disengage at least a portion of a second module 20 from its socketed position in electrical connector 12. Advantageously, electrical connector 12 will function with or without module ejector assembly 10. When required, the electrical connector 12 is designed so that the ejector assembly 10 can easily be "snapped" into position in the electrical connector 12 when loaded, for example, from the top of the connector 12.

Figure 3:
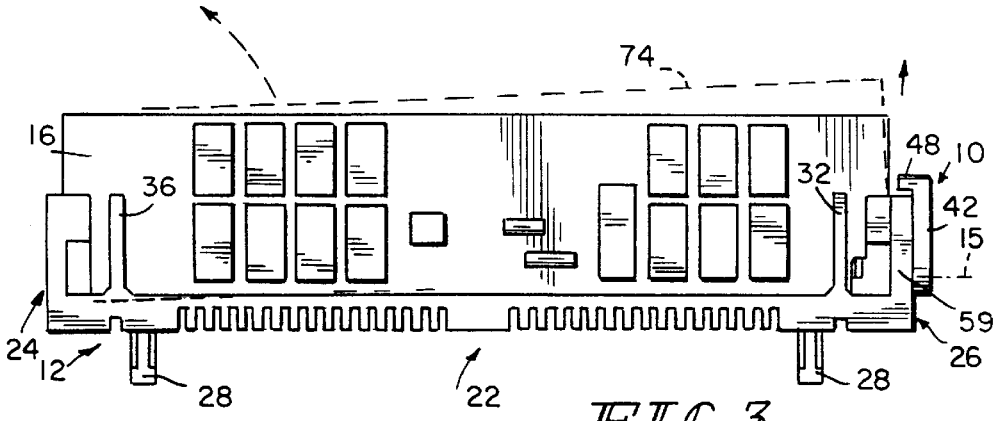
FIG. 3 is a side elevation view of a module socketed in an electrical connector showing the location of a module ejector assembly at one end of the electrical connector and showing in phantom lines the location of the module following rotation of the module ejector assembly to disengage a portion of the module from its socketed position in the electrical connector.

Referring to FIGS. 1 and 3, an electrical connector includes a base 22 and first and second end pieces 24, 26 formed at opposite ends of the base 22. A plurality of polarization plugs 28 are provided on the bottom of base 22 to permit base 22 to be mounted to a printed circuit board or other apparatus (not shown). The base 22 is formed to include an upwardly opening first socket chamber 30 for receiving and retaining module 16 therein and a second socket chamber (not shown) for receiving and retaining the second module 20 therein. It will be understood that a module is an electrical component, edge card, device, or apparatus that can be deposited into a socket chamber such as chamber 30 and held in mechanically and electrically coupled relation to the electrical connector.

Figure 2:
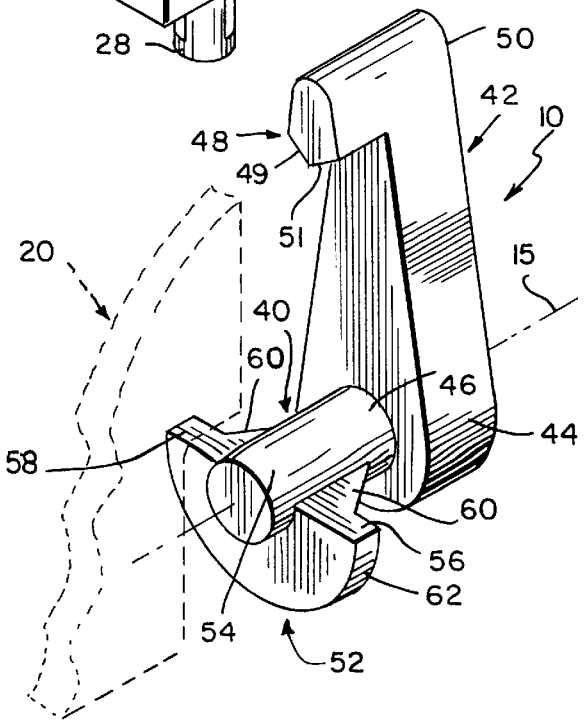
FIG. 2 is an enlarged view of the rotatably actuated module ejector assembly illustrated in FIG. 1 showing a lever arm, pivot post, and a cam member included in the ejector assembly and a module portion shown in phantom lines and arranged to be ejected from an electrical connector socket by the cam member upon pivoting movement of the lever arm with respect to the electrical connector about an axis of rotation.

A first external beam 32 is appended to the connector base 22 as shown in FIGS. 1 and 2 and arranged to extend upwardly in spaced-apart relation to the end piece 26 to provide means for stabilizing module 16 in an upright position while retained in socket chamber 30. Likewise, a second external beam 34 is appended to connector base 22 as shown in FIG. 1 and arranged in spaced-apart relation to the opposite side of end piece 26 to extend upwardly and engage the second module 20 to support second module 20 in a stable upright position while it is received in its socket chamber (not shown) formed in connector base 20. An internal member 35 is provided on connector 12 between the first and second socket chambers and configured to engage and support the opposing inner facing walls of the first and second modules 16, 20 as shown in FIG. 1.

Another external stabilizing beam like beam 32 is provided in close proximity to the opposite end piece 24 as shown in FIG. 3 to stabilize the other end of module 16. Likewise, another external stabilizing beam (not shown) is provided to stabilize the opposite end of the second module 20 while module 20 is socketed in connector base 22. A second internal member (not shown) is provided to help support the modules 16, 20 in upright positions in the socket.

The configuration of the module ejector assembly 10 is shown in detail in FIG. 2. The assembly 10 includes a pivot post 40 that extends through a channel formed in end piece 26 and is snapped into position and supported for rotation about axis of rotation 15. Conveniently, the ejector assembly 40 is mounted for rotation on end piece 26 by moving pivot post 40 downwardly through vertical slot 41 until it snaps into the channel formed at the bottom of slot 41. Once snapped in place, the ejector assembly 10 is free to rotate about axis of rotation 15.

The assembly 10 also includes a pivotable lever arm 42 having a proximal end 44 coupled to the outer end 46 of pivot post 40 and a grip handle 48 formed at the distal end 50 of lever arm 42. A half moon-shaped cam member 52 is appended to an inner end 54 of the pivot post 40 so that its center point is coincident with the axis of rotation 15 of pivot post 40. The cam member 52 includes a first ejector flange 56 for ejecting module 16 from a socketed position in connector base 22 and a second ejector flange 58 for ejecting second module 20 from a socketed position in connector base 22. Advantageously, the ejector assembly 10 includes two ejector flanges 56 and 58 and is thus operable to eject two modules from an electrical connector one at a time.

A conically shaped support web 60 extends from a flat face 62 of cam member 52 upwardly and outwardly to mate with a central portion of pivot post 40. Web 60 provides means for supporting cam member 52 in a rigid relation to pivot post 40 as shown best in FIGS. 2 and 6.

The module ejector assembly 10 is preferably configured in the manner shown in FIG. 2 to make it easy to mold or cast the assembly 10 as a one-piece unit. Preferably, the ejector assembly 10 is fabricated by simple injection molding methods using a plastics material. The ejector assembly 10 can also be fabricated as a casting to provide increased strength and durability. It will be understood that support web 60 is configured to have a conical shape to simplify the molding of cam member 52 in addition to providing increased strength and rigidity of the molded module ejector assembly 10. Of course, the lever arm 42, pivot post 40, and cam member 52 could be fabricated using separate parts or subassemblies. This ejector assembly 10 is compact and occupies a very small place on the electrical connector 12. Nevertheless, it provides great ease and comfort to the end user.

Figure 4:
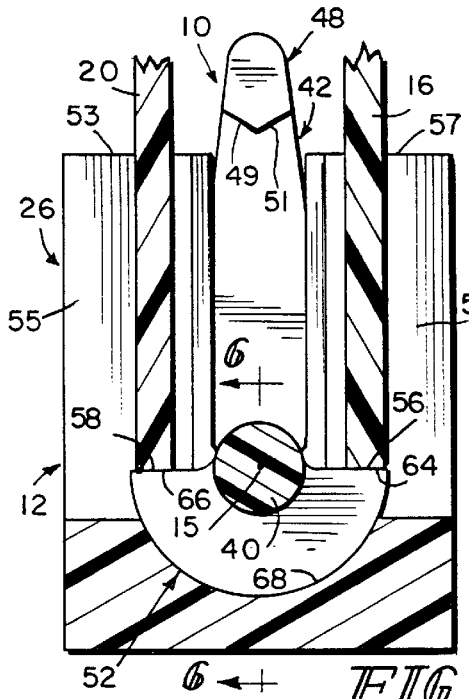
FIG. 4 is a sectional view taken along lines 4—4 of FIG. 1 showing the position of a cam member and two side-by-side modules prior to actuation of the module ejector assembly.
Figure 5:
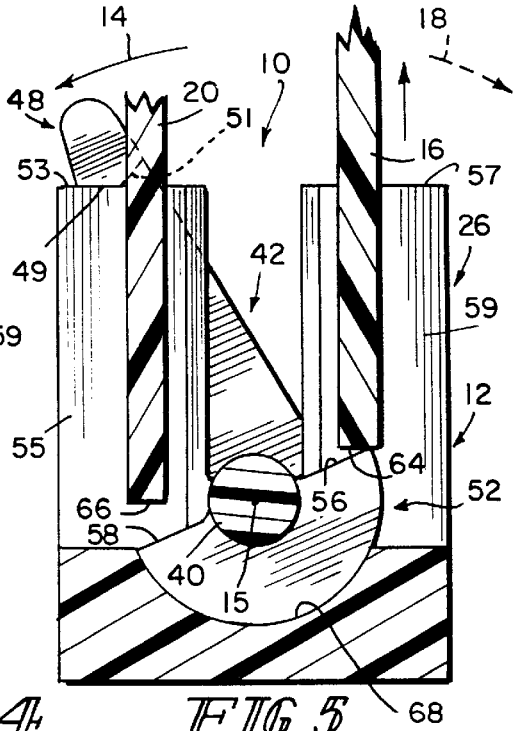
FIG. 5 is a view similar to FIG. 4 showing rotation of the lever arm, pivot post, and cam member in a counterclockwise direction about the axis of rotation to disengage one of the modules from its socketed position in the electrical connector without disengaging the second module from its socketed position in the electrical connector.
Figure 6:
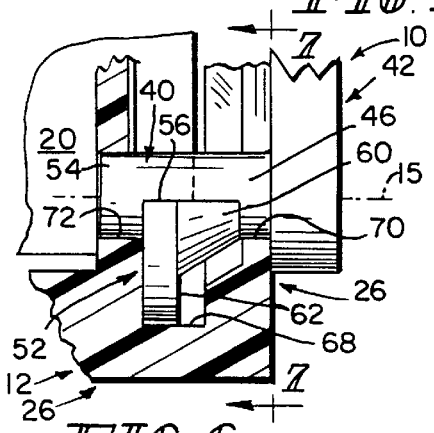
FIG. 6 is a sectional view taken along lines 6—6 of FIG. 4 showing the manner in which the module ejector assembly is mounted for rotation in various channels and grooves provided in the end piece of the electrical connector.
Figure 7:
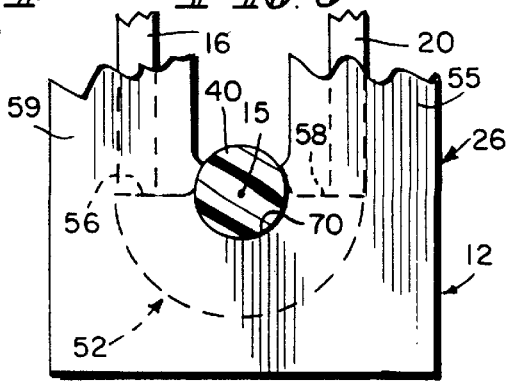
FIG. 7 is a sectional view taken along lines 7—7 of FIG. 6 showing the manner in which the pivot post is supported in a channel formed in the end piece to permit rotation of the pivot post and the cam member relative to the electrical connector.

The innovative manner in which rotatably actuated module ejector assembly 10 is used to eject one or the other of modules 16 or 20 from a socketed position in electrical connector 12 is illustrated in FIGS. 4 and 5. Initially, both modules 16 and 20 are received in their respective socket chambers in electrical connector 12 and the module ejector assembly 10 is rotated about axis of rotation 15 to assume an inactive, upright, vertical orientation as shown in FIG. 4. In this position, the first ejector flange 56 abuts against a lower edge 64 of module 16 and the second ejector flange 58 on cam member 52 abuts against a lower edge 66 on module 20. A contoured channel 68 is formed in connector base 22 as shown in FIGS. 4-6 to support the half moon-shaped cam member 52 for rotation about axis of rotation 15. As shown in FIG. 6, the end piece 26 of electrical connector 12 is also formed to include a first channel 70 for rotatably supporting the outer end 46 of pivot post 40 and an inner channel 72 for rotatably supporting the inner end 54 of pivot post 40.

The first module 16 is extracted easily from electrical connector 22 using the module ejector in the following manner. A technician simply grips lever arm 42 at grip handle 48 and pivots lever arm 42 about axis of rotation 15 in direction 14 to cause the entire module ejector assembly 10 to rotate about pivot axis 15 so that the first ejector flange 56 on cam member 52 moves upwardly against the lower edge 64 of module 16. Sufficient pivoting movement of lever arm 42 (e.g., about 30° from the vertical) will cause at least a portion of the lower edge of module 16 to disengage from its socketed position in socket chamber 30 to release the module 16 to the position shown in phantom at 74 in FIG. 3. A technician may now easily extract the module 16 from the electrical connector to permit repair or replacement of that module in the electrical connector 12.

The vertical lever arm 42 of the ejector assembly 10 includes a grip handle 48 which serves as the actuation surface for the end user. This grip handle 48 provides a horizontal extension on the vertical lever arm 42 which stretches over the top of the socket on the electrical connector 12. Its length provides a large surface area on which the end user would grip to actuate the ejector assembly 10. This large surface area reduces the force per square inch that must be applied to eject a module for connector 12, thereby minimizing any pain that might otherwise be sensed by the end user.

As shown in FIG. 5, this grip handle 48 also includes a pair of flat stop surfaces 49, 51. Stop surface 49 engages the top wall 53 of column 55 on end piece 26 to provide a positive stop to limit rotation of lever arm 42 in direction 14. Essentially, the grip handle 48 "bottoms out" on the top wall 53 of end piece 26. Such bottoming out notifies the user of a completed ejection process and also prevents over-actuation of the module ejector assembly 10. Likewise, grip handle 48 also includes a stop surface 51 which engages the top wall 57 of column 59 on end piece 26 to provide a positive stop to limit rotation of lever arm 42 in direction 18.

Advantageously, no extra room is required beyond the end piece 26 of the electrical connector 12 for a user to orient his or her finger next to the connector in a proper position to operate module ejector assembly 10 owing to the fact that the location of the grip handle 48 above the connector 12 makes it unnecessary for a user to insert a finger alongside the connector 12. The user's finger can move downwardly toward the top of the connector 12 to reach and actuate the module ejector assembly 10. This is an improvement over connectors 12 having an ejector which can only be actuated by means of a finger placed alongside the end of the connector 12.

Referring again to FIG. 5, it will be seen that at the same time the lever arm 42 is rotated in direction 14 to eject module 16, the second ejector flange 58 on cam member 52 is rotated about axis of rotation 15 away from the lower edge 66 of the second module 20. Thus, the lever arm 42 can be pivoted to eject module 16 without upsetting the socketed connection of module 20 in electrical connector 12. Alternatively, lever arm 42 could be rotated about axis of rotation 15 in the opposite direction 18 (e.g., about 30° from the vertical) to eject module 20 from its socketed position in electrical connector 12. Thus, module ejector assembly 10 is operable to eject in sequence two modules from a connector.

Although the invention has been described in detail with reference to certain preferred embodiments and specific examples, variations and modifications exist within the scope and spirit of the invention as described and defined in the following claims.

What is claimed is:

1. An ejector for use in a socket having side-by-side slots for receiving electronic devices such as memory modules and circuit cards, said ejector comprising:

a cam of a given length and having two lifting lobe means spaced outwardly in opposite directions from a mid-point and located on a common edge, each one of said two lifting lobe means being adapted to underlie a portion of an electronic device which may be positioned in one of the side-by-side slots; and actuating means connected to said mid-point on said cam to cause said cam to be rotated to raise a respective one of said two lifting lobe means.

2. The ejector of claim 1 wherein said two lifting lobe means include surfaces of said common edge.

3. The ejector of claim 1 wherein said actuating means include a handle.

4. The ejector of claim 3 further including connecting means connecting said handle to said mid-point on said cam.

5. The ejector of claim 3 wherein said handle includes a pair of flat stop surfaces which, during use of said ejector, engage the socket to provide a positive stop to limit rotation of said handle.

6. A socket for electronic devices such as memory modules and printed circuit substrates, said socket comprising:

a housing having adjacent slots for receiving electronic devices;

a cam having two lifting lobe means spaced outwardly in opposite directions from a mid-point of said cam, said cam being rotatably positioned in said housing with each one of said two lifting lobe means being adapted to underlie a portion of an electronic device which may be positioned in one of said adjacent slots; and actuating means for rotating said cam to raise a respective one of said two lifting lobe means.

7. The socket of claim 6 wherein said actuating means is engageable by a tool.

8. The socket of claim 6 wherein said cam is positioned at one end of said adjacent slots with said actuating means extending outwardly from said housing.

9. The socket of claim 8 wherein said cam is located in a pocket defined in part by a wall having gaps therethrough which are in registration with said adjacent slots.

10. The socket of claim 9 further including connecting means connecting said actuating means to said mid-point on said cam.

11. The socket of claim 6 wherein said actuating means include a handle.

12. The socket of claim 11 wherein said handle includes a pair of flat stop surfaces which, during use of said socket, engage said housing to provide a positive stop to limit rotation of said handle.

13. An ejector for use in a socket having side-by-side slots for receiving electronic devices such as memory modules and circuit cards, said ejector comprising:

(a) two lifting lobes spaced outwardly in opposite directions from a mid-point, each one of said two lifting lobes being adapted to underlie a part of an electronic device which may be positioned in one of the side-by-side slots, and (b) actuating means connected to said mid-point to cause said two lifting lobes to be rotated to raise a respective one of said two lifting lobes.

14. The ejector of claim 13 wherein said actuating means includes a handle.

15. The ejector of claim 14 wherein said handle includes a pair of flat stop surfaces which, during use of said ejector, engage the socket to provide a positive stop to limit rotation of said handle.

16. The ejector of claim 14 further including connecting means connecting said handle to said mid-point.

17. A socket for electronic devices such as memory modules and printed circuit cards, said socket comprising:

(a) a housing having adjacent slots for receiving electronic devices;

(b) two lifting lobes spaced outwardly in opposite directions from a mid-point, each one of said two lifting lobes being adapted to underlie a portion of an electronic device which may be positioned in one of said adjacent slots; and (c) actuating means for rotating said two lifting lobes to raise a respective one of said two lifting lobes.

18. The socket of claim 17 wherein said actuating means is engagable by a tool.

19. The socket of claim 17 wherein said actuating means includes a handle.

20. The socket of claim 19 wherein said handle includes a pair of flat stop surfaces which, during use of said socket, engage said housing to provide a positive stop to limit rotation of said handle.

21. The socket of claim 17 wherein:

(a) said two lifting lobes are positioned at one end of said adjacent slots and (b) said actuating means extends outwardly from said housing.

22. The socket of claim 21 wherein said two lifting lobes are located in a pocket defined in part by a wall having gaps therethrough which are in registration with said adjacent slots.

23. The socket of claim 22 further including connecting means connecting said actuating means to said mid-point.

* * * * *